US005597007A

United States Patent [19]

Ju

[11] Patent Number: 5,597,007

[45] Date of Patent: Jan. 28, 1997

[54] FOLDABLE TENT FRAME

[75] Inventor: Dong S. Ju, Seoul, Rep. of Korea

[73] Assignee: Baejin Corporation, Rep. of Korea

[21] Appl. No.: 517,086

[22] Filed: Aug. 21, 1995

[30] Foreign Application Priority Data

Feb. 27, 1995 [KR] Rep. of Korea ..... 3200/1995

[51] Int. Cl.[6] ..... E04H 15/00

[52] U.S. Cl. ..... 135/124; 135/127; 403/329

[58] Field of Search ..... 135/124, 127; 52/655.1; 403/326, 329, 106, 375, 376, 380

[56] References Cited

U.S. PATENT DOCUMENTS

| | | | |
|---|---|---|---|
| 1,269,413 | 6/1918 | Finnigan | 403/106 X |
| 2,491,356 | 12/1949 | Anderson | 403/329 |
| 3,187,521 | 6/1965 | Morris et al. | 403/326 X |
| 3,719,378 | 3/1973 | Windsor | 403/375 X |
| 3,950,813 | 4/1976 | Buck | 403/329 X |
| 4,819,402 | 4/1989 | Schneider | 52/655.1 X |
| 5,086,601 | 2/1992 | Galowitz | 52/656.9 X |
| 5,156,064 | 10/1992 | Truman | 403/106 X |

FOREIGN PATENT DOCUMENTS

| | | | |
|---|---|---|---|
| 3244398 | 6/1984 | Germany | 403/375 |

*Primary Examiner*—Carl D. Friedman
*Assistant Examiner*—Beth Aubrey
*Attorney, Agent, or Firm*—Feix & Feix

[57] ABSTRACT

An improvement of a foldable tent frame, and particularly an improvement of joint portion is disclosed. The foldable tent frame includes a plurality of frame member segments 10 and a plurality of joint portions 11 to be coupled with each other through an injection molding using a molding die. The frame member segment 10 and the joint portion 11 are characterized in that the frame member segment is provided with a channel shape recess 17 having two side walls 19 and 19*a* and a planar bottom 18, and that the frame member segment is further provided with an elongate conical end portion, whereby the joint portion and the frame member segment are firmly integrally attached together. Thus a loose rotation of the joint portion relative to the frame member segment, or a detachment of the joint portion from the frame member segment is prevented, thereby providing a strong frame to support the tent.

8 Claims, 3 Drawing Sheets

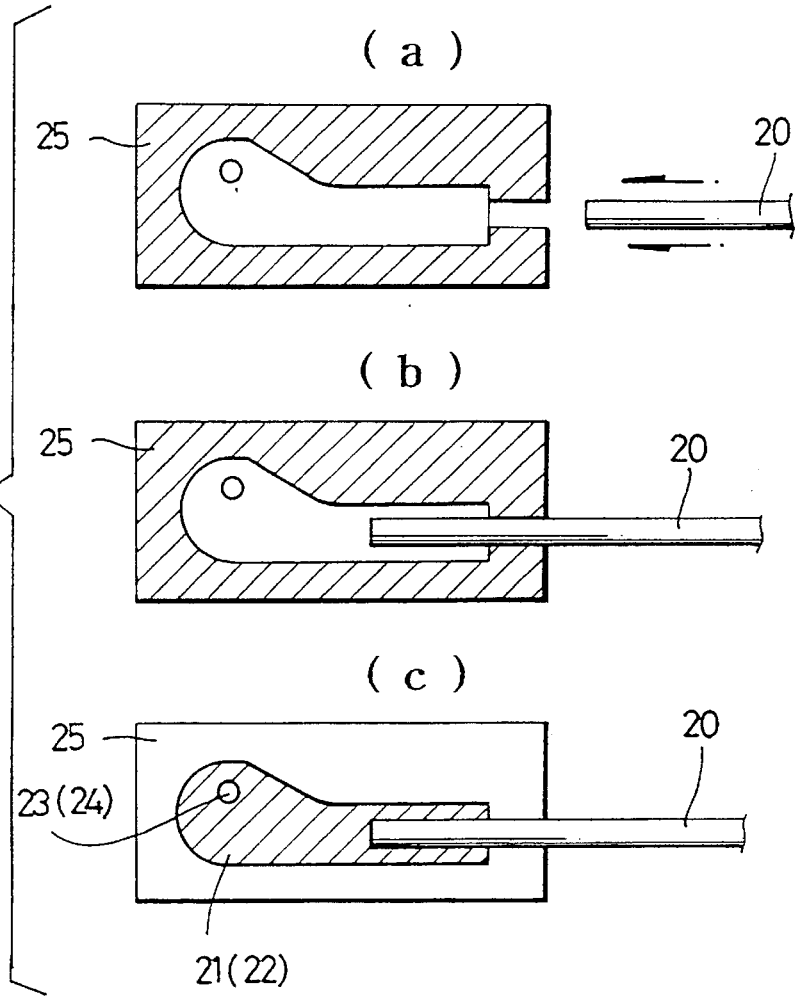
FIG. 3
PRIOR ART
FIG. 4
PRIOR ART
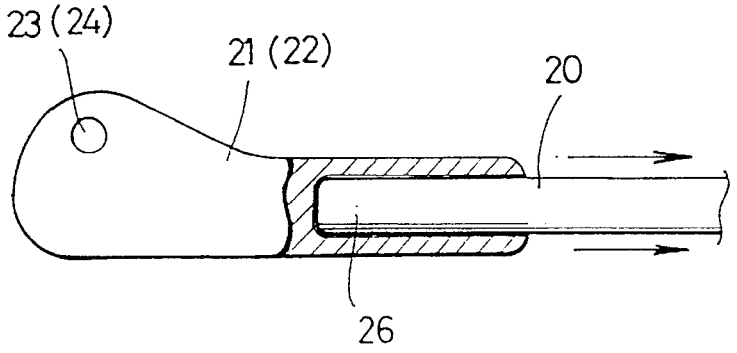

FOLDABLE TENT FRAME

BACKGROUND OF THE INVENTION

1. Field of the invention

The present invention relates to a foldable tent frame, and particularly to a foldable dome shaped tent frame made of a synthetic resin, in which tent frame members extend from a central fastening hub in a radiative form, and each of the frame members consists of frame segments joined together through joints, so that the folding and unfolding of the tent would be convenient.

2. Description of the prior art

As shown in FIGS. 2 to 4, the general conventional dome shaped foldable tent frame is constituted as follows.

That is, male and female joint portions 21 and 22 which are made of a synthetic resin are fitted to the both ends of a rod shaped frame segment 20 which is also made of a synthetic resin.

This frame member segment 20 is pivotally joined to another frame member segment 20 by utilizing holes 23 and 24 which are formed on the joint portions 21 and 22 respectively.

Thus when the tent is folded, the frame member segments are folded through the opposite joint portions 21 and 22 in multiple steps. On the other hand, when the tent is unfolded, the frame member segments 20 form arcuate poles, and the male and female joint portions 21 and 22 form strong joinings with the joint portions 21 and 22 of an adjacent frame member segment 20, thereby strongly supporting the tent in a dome shape.

However, in order to ensure convenience and to maintain the elasticity and strength of the tent frame, the joint portions 21 and 22 are not provided integrally with the frame member segment 20, but are formed in the following manner. That is, the frame member segments are formed by cutting an extruding rod by a certain length, and then, the joint portions made of a synthetic resin are formed on the ends of the frame member segment by being inserted into a molding die.

As shown in FIG. 3, the attachment of the opposite joint portions 21 and 22 to the frame member segment is carried out in the following manner. That is, first one end of the frame member segment 20 is inserted into a joint portion molding die 25, and a synthetic resin is injected into the molding die 25 to form the joint portion 21, while the other end of the frame member segment is let to undergo the same process, thereby integrally attaching the joint portions 21 and 22 to the opposite ends of the frame member segment 20.

However, according to this attaching method, the end portions of the frame member segment is smoothly cylindrical as shown in FIG. 4, and therefore, when the tent is repeatedly used by folding and unfolding the tent, the frame member segments are repeatedly deflected into an arcuate form.

Therefore, the frame member segments are subjected to deflecting stresses and twisting stresses repeatedly, and therefore, the frame member segments 20 are detached from the joint portions 21 and 22, or the joint portions 21 and 22 are loosely rotated relative to the frame member segment 20.

Consequently, the tent is liable to be easily damaged. Further, if a joint portion becomes loose relative to the frame member segment 20 so as to be rotated by 180°, then the relevant frame member segment 20 cannot give an arcuately supporting strength, but the relevant portion is collapsed.

In an attempt to overcome the above described disadvantage, a tent frame was proposed as shown in FIG. 5. As shown in FIG. 5, a rivetting hole 37 is formed on a fitting portion 36 of a frame member segment 30 to which a joint portion 31 is fitted. Then a rivet 38 is fastened into the rivetting hole 37.

In this case, a loose rotation or a detachment of the joint portion 31 can be prevented, but the drilling of the hole and the fastening of the rivet cause the manufacturing cost increased. Further, the drilling of the rivetting hole forms a weak portion on the frame member segment, and therefore, the strength of the frame member segment is weakened, with the result that the life expectancy of the tent frame is shortened.

Meanwhile, FIG. 5 illustrates a constitution as follows. That is, each of the ends 46 of the frame member segment 40 is provided with an L shaped step 47, before forming the joint portions 41. In this case, owing to an planar portion 48 of the step 47, a loose rotation of the joint portion 41 is prevented, but a detachment of the frame member segment in the axial direction cannot be prevented.

Furthermore, the step of the joint portion 41 is formed by simply cutting off the end portion of the frame member segment 40. Therefore, in order to secure a sufficient joining strength, if the end portion of the frame member segment is deeply inserted into the joint portion 41, then the end of the frame member segment approaches the hole of the joint portion too close, with the result that the strength of the portion around the hole is weakened.

In order to avoid this phenomenon, if the end portion of the frame member segment is inserted into the joint portion too little, then the joining strength is decreased and moreover the joint portion would be apt to break off easily.

SUMMARY OF THE INVENTION

The present invention is intended to overcome the above described disadvantages of the conventional techniques.

Therefore it is the object of the present invention to provide a foldable tent frame in which a channel shaped recess is formed near the end portion of the frame member segment, and the end portion of the frame member segment is formed in an elongate conical shape, so that a loose rotation and detachment of the joint portion would be prevented, and that the frame member segments can be firmly assembled.

Further, the depth of the attachment between the frame member segment and the joint portion is maintained sufficiently, and also the end of the frame member segment does not approach the joint pin hole, so that the attaching strength between the joint portion and the frame member segment would be increased.

BRIEF DESCRIPTION OF THE DRAWINGS

The above object and other advantages of the present invention will become more apparent by describing in detail the preferred embodiment of the present invention with reference to the attached drawings in which:

FIG. 3 illustrates the conventional process for forming the joint portion;

FIG. 4 is a side view of the critical portion of the conventional frame member segment and joint portion;

DESCRIPTION OF THE PREFERRED EMBODIMENT

The present invention will be described in detail referring to FIGS. 6 and 7.

Figure 1:
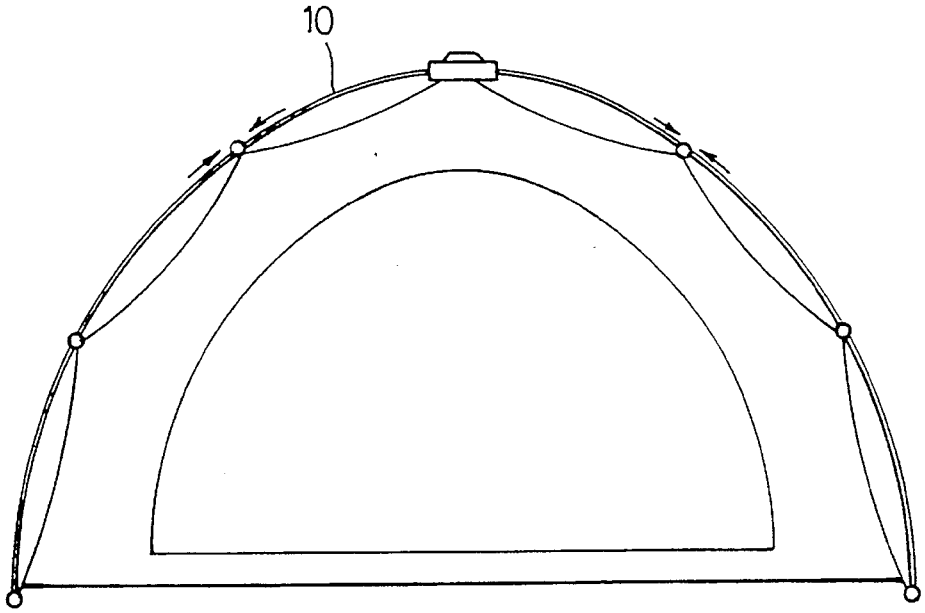
FIG. 1 is a frontal view of the tent according to the present invention.
Figure 2:
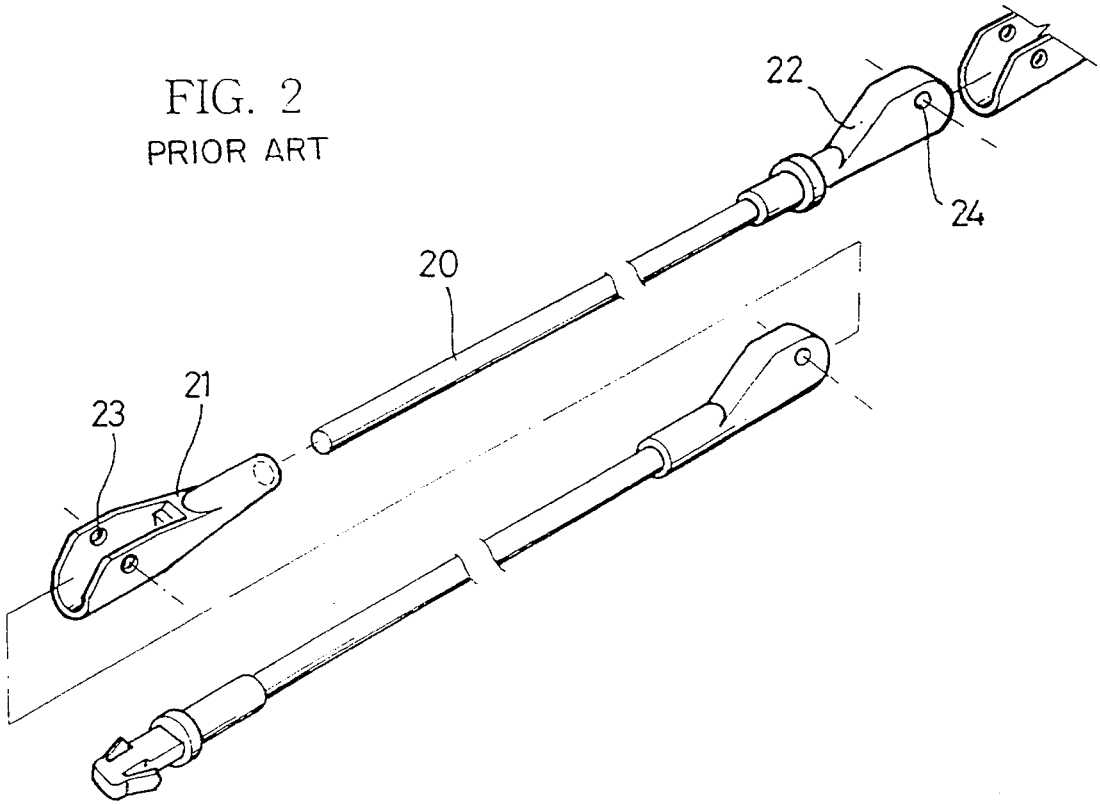
FIG. 2 PRIOR ART
FIG. 2 is an exploded perspective view of the conventional frame member segment and joint portions.
Figure 5:
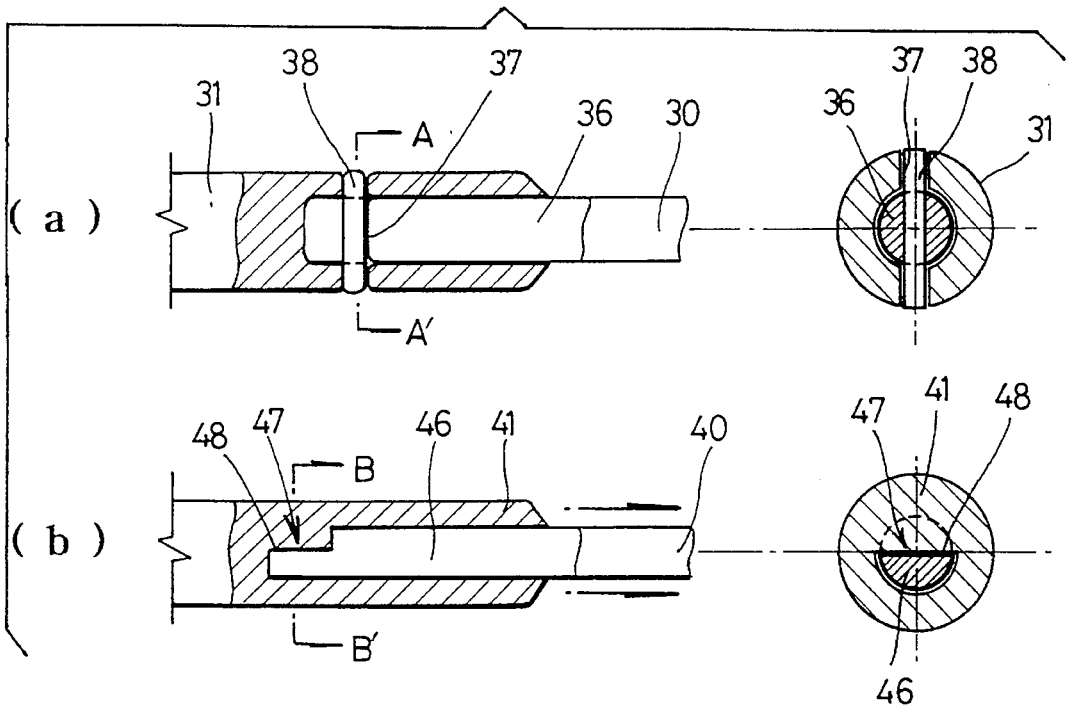
FIG. 5 PRIOR ART
FIG. 5 is a partially cut-away view and a sectional view showing another type of the conventional frame member segment and joint portion.
Figure 6:
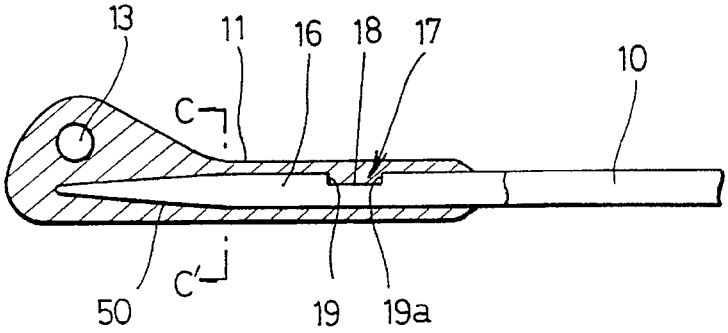
FIG. 6 is a side sectional view of the critical portion of the frame member segment and the joint portion according to the present invention.
Figure 7:
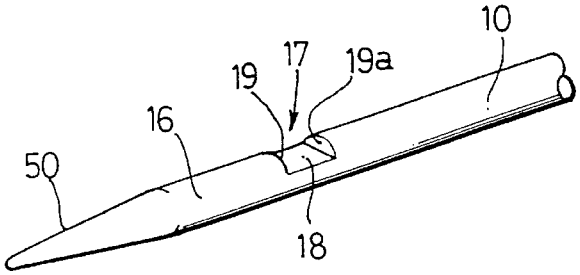
FIG. 7 is a perspective view of the cortical portion of device of the present invention.

As shown in FIGS. 6 and 7, each of end portions 16 of a tent frame member segment 10 of the present invention is inserted into a molding die (not shown), and then, a synthetic resin is injected into the molding die and injected to around the end portion (hatching portion) of the frame member segment 10, so that a joint portion 11 would be formed, the joint portion 11 being provided with a joint pin hole 13. The above described process is same as that of the conventional technique.

In the present invention, however, before carrying out the injection molding, a channel shaped dented recess 17 is made near the end portion of the frame member segment 10, the dented recess 17 having side walls 19 and 19*a* and a planar bottom 18. Then the injection molding is carried out as described above, in such a manner that the synthetic resin would also be filled in the channel shaped dented recess 17, and that the joint portion 11 would be formed around the conical end portion 16 of the frame member segment, after the injected synthetic resin has been dried up and turned solid.

In the structure formed in the above described manner, the channel shaped recess 17 is filled with and made of the synthetic resin of the joint portion 11 down the planar bottom 18, and therefore, a loose rotation or a pull-out of the joint portion 11 could be prevented, because the side walls 19 and 19*a* of the channel shaped dented recess 17 prevent any axial movements of the frame members segment 10.

Thus, the strength of the joint portions of the tent frame is greatly reinforced, and therefore, damages are not liable to occur, with the result that the life expectancy of the tent frame should be extended.

Further, the end portion 16 of the frame member segment 10 which is also made of a synthetic resin is sharpened into a conical form 50 in advance so as to be buried into the joint portion 11 in an integral form.

Owing to the elongate conical portion 50 of the end portion 16 of the frame member segment 10, the end portion 16 of the frame member segment 10 can be deeply buried into the joint portion 11, but the end portion 16 does not approach the joint pin hole 13 which is formed in the joint portion 11.

Therefore the strength of this portion is preserved, and the deep insertion of the frame member segment 10 into the joint portion 11 improves the attaching strength between the two elements.

In the conventional device, the frame member segment does not go beyond a line C—C of FIG. 6 into the joint portion, and therefore, a large stress is concentrated along the line C—C of FIG. 6.

However, in the present invention, the end portion 16 of the frame member segment 10 goes beyond the line C—C deep into the joint portion 11, and therefore, the coupling strength between the frame member segment 10 and the joint portion 11 is greatly reinforced owing to the provision of the conical end portion 50.

According to the present invention as described above, when molding the joint portion by inserting each of the ends of the frame member segment into a molding die, the end portion of the frame member segment is provided with a channel shaped recess in advance, and the end portion of the frame member segment is formed in an elongate conical shape.

Therefore, the joining between the joint portion and the frame member segment becomes very strong, and any loose rotation or twisting of the joint portion relative to the frame member segment is prevented, so that the tent frame would provide a great strength in maintaining the dome shape of the tent of which the frame members are bowed outwardly when tent is erected. Further, any axial departure of the joint portion from the frame member segment is also prevented. That is, when molding the joint portion, the synthetic resin is filled into the channel shaped recess 17 of the frame member segment 10, and the elongate conical end portion of the frame member segment is deeply buried into the joint portion 11.

Therefore, even if stress is concentrated on the joint portion 11, the tent frame becomes strong enough to maintain the dome shape of the tent against external influencing force such as a wind Blow.

What is claimed is:

1. For a foldable dome shape tent of the type which comprises a plurality of arcuate frame members extending from a central fastening hub and wherein the arcuate frame members each comprise a plurality of elongated frame member segments having end portions on which are provided joint portions, the joint portions being effective to permit the frame member segments to be moved between a first, folded position to permit compact stowage of the tent, and a second, unfolded position which enables the frame member segments to form the arcuate frame members to support the tent in a dome shape deployed position, a method for fabricating a firm connection between a frame member segment and a respective joint portion in a manner which prevents loose axial rotation and separation between the frame member segment and the joint portion, the method comprising:

a) providing an elongated frame member segment having a longitudinal axis and an end portion;

b) forming a channel shaped dented recess adjacent the end portion of the frame member segment, the channel shape recess being oriented substantially transverse to the longitudinal axis of the frame member segment;

c) inserting the end portion of the frame member segment into a molding die corresponding to a desired joint portion configuration; and d) forming a joint portion onto the end portion of the frame member segment by injecting resin into the molding die and allowing the resin to cool and harden, and whereby the resin which fills the channel shaped indented recess prevents loose axial rotation and separation between the frame member segment and the joint portion.

2. The method of claim 1 which further includes forming the end portion of the frame member segment as an elongated conical end portion.

3. The product of the method of claim 1.

4. The product of the method of claim 2.

5. In a foldable tent frame of the type which includes a plurality of arcuate frame members extending from a central fastening hub, the arcuate frame members each including a plurality of elongated frame member segments having end portions on which are provided joint portions formed in an injection molding die, and wherein the joint portion include pin holes so that adjacent joint portions can be coupled together by a transverse pin to permit a limited range of pivot movement to allow the frame member segments to unfold and form the arcuate frame members, wherein the improvement comprises:

a) a channel shaped dented recess disposed adjacent an end portion of each frame member segment, the channel shape recess being oriented substantially transverse to a longitudinal axis of the frame member segment; and b) said channel shape dented recess having a planar bottom and upstanding end walls of a depth sufficient to provide an integral connection between the frame member segment and the surrounding injection molded joint portion and to prevent loose axial rotation and separation between the frame member segment and the injection molded joint portion.

6. The invention of claim 5 wherein the end portion of the frame member segment is configured as an elongated conical end portion that is effective to extend into the injected molded joint portion at a depth sufficient to provide increased strength of the joint portion in a region of a pin connection with an adjacent joint portion.

7. Foldable tent frame, comprising:

a) a plurality of arcuate frame members extending from a central fastening hub, the arcuate frame members each including a plurality of elongated frame member segments having end portions on which are provided joint portions formed in an injection molding die, and wherein the joint portion include pin holes so that adjacent joint portions can be coupled together by a transverse pin to permit a limited range of pivot movement to allow the frame member segments to unfold and form the arcuate frame members;

b) a channel shaped dented recess disposed adjacent an end portion of each frame member segment, the channel shape recess being oriented substantially transverse to a longitudinal axis of the frame member segment; and c) said channel shape dented recess having a planar bottom and upstanding end walls of a depth sufficient to provide an integral connection between the frame member segment and the surrounding injection molded joint portion and to prevent loose axial rotation and separation between the frame member segment and the injection molded joint portion.

8. The invention of claim 7 wherein the end portion of the frame member segment is configured as an elongated conical end portion that is effective to extend at a depth within the injected molded joint portion to provide increased strength of the joint portion in a region of a pin connection with an adjacent joint portion.

* * * * *